United States Patent [19]

Tranquillitsky

[11] 3,999,660

[45] Dec. 28, 1976

[54] CAN CARRIER AND METHOD FOR MAKING THE SAME

[76] Inventor: George V. Tranquillitsky, 3161 Lynde St., Oakland, Calif. 94601

[22] Filed: Aug. 13, 1975

[21] Appl. No.: 604,421

Related U.S. Application Data

[63] Continuation of Ser. No. 489,132, July 17, 1974, abandoned.

[52] U.S. Cl. ..... 206/434; 206/141; 229/40; 224/45 AB

[51] Int. Cl.[2] ..... B65D 65/00

[58] Field of Search ..... 206/434, 141, 147, 148, 206/161; 224/45 AB; 229/40

[56] References Cited

UNITED STATES PATENTS

| | | | |
|---|---|---|---|
| 2,722,365 | 11/1955 | Phipps | 206/434 |
| 2,779,499 | 1/1957 | Chidsey, Jr. | 206/141 |
| 3,140,036 | 7/1964 | Spely | 206/141 |

*Primary Examiner*—Robert J. Spar
*Assistant Examiner*—Kenneth Noland
*Attorney, Agent, or Firm*—Philips, Moore, Weissenberger, Lempio & Strabala

[57] ABSTRACT

A one-piece paperboard blank is formed into a can carrier by sequentially folding and gluing the panels and flaps of the blank together while moving it along a linear path. The completed "six-pack" carrier comprises top and bottom panels connected together by a pair of end panels and a pair of first and second partitions secured between the top and bottom panels and disposed intermediate the end panels to define three separate cells. A flap secures the bottom panel to each of the partitions whereas a bridging panel secures the partitions to the top panel.

10 Claims, 5 Drawing Figures

A
B
C
P
10
11
12
13
14
15
16
17
18
19
20
21
22
23
24
25
26
27
28
29
30
31
32
33
34
35
36
37
38
39
40
42
43

CAN CARRIER AND METHOD FOR MAKING THE SAME

This is a continuation, of Ser. No. 489,132, filed July 17, 1974 now abandoned.

BACKGROUND OF THE INVENTION

The spiralling costs of paperboard and like packaging materials has dictated the need for can carriers which can be constructed from a minimum amount of material. Whereas certain prior art can carrier constructions attempt to achieve such material savings, they oftentimes impair the structural integrity of the carrier and require complicated apparatus and methods for making the same. Wrap-around carriers of this type are disclosed in U.S. Pat. Nos. 2,656,960; 2,722,365; 2,790,590; 2,812,105; 2,834,508; 2,839,235; 2,980,249; 3,161,344; and 3,283,990.

SUMMARY OF THE INVENTION

An object of this invention is to provide an economical carrier for cans and like articles which exhibits a high degree of structural integrity and a method for making the same expeditiously. The carrier comprises top and bottom panels connected together by a pair of end panels and a pair of upstanding partitions disposed in parallel relationship with respect to the end panels to define three article-carrying cells in the carrier. A flap secures the bottom panel to each of the partitions and a bridging panel, interconnecting the upper ends of the partitions, is secured to an underside of the top panel. The carrier is formed by moving the carrier's one-piece blank along a linear path and by sequentially folding and securing such panels together during such movement.

BRIEF DESCRIPTION OF THE DRAWINGS

Other objects of this invention will become apparent from the following description and accompanying drawings

DETAILED DESCRIPTION

Figures 1, 2, 3, 4, 5:
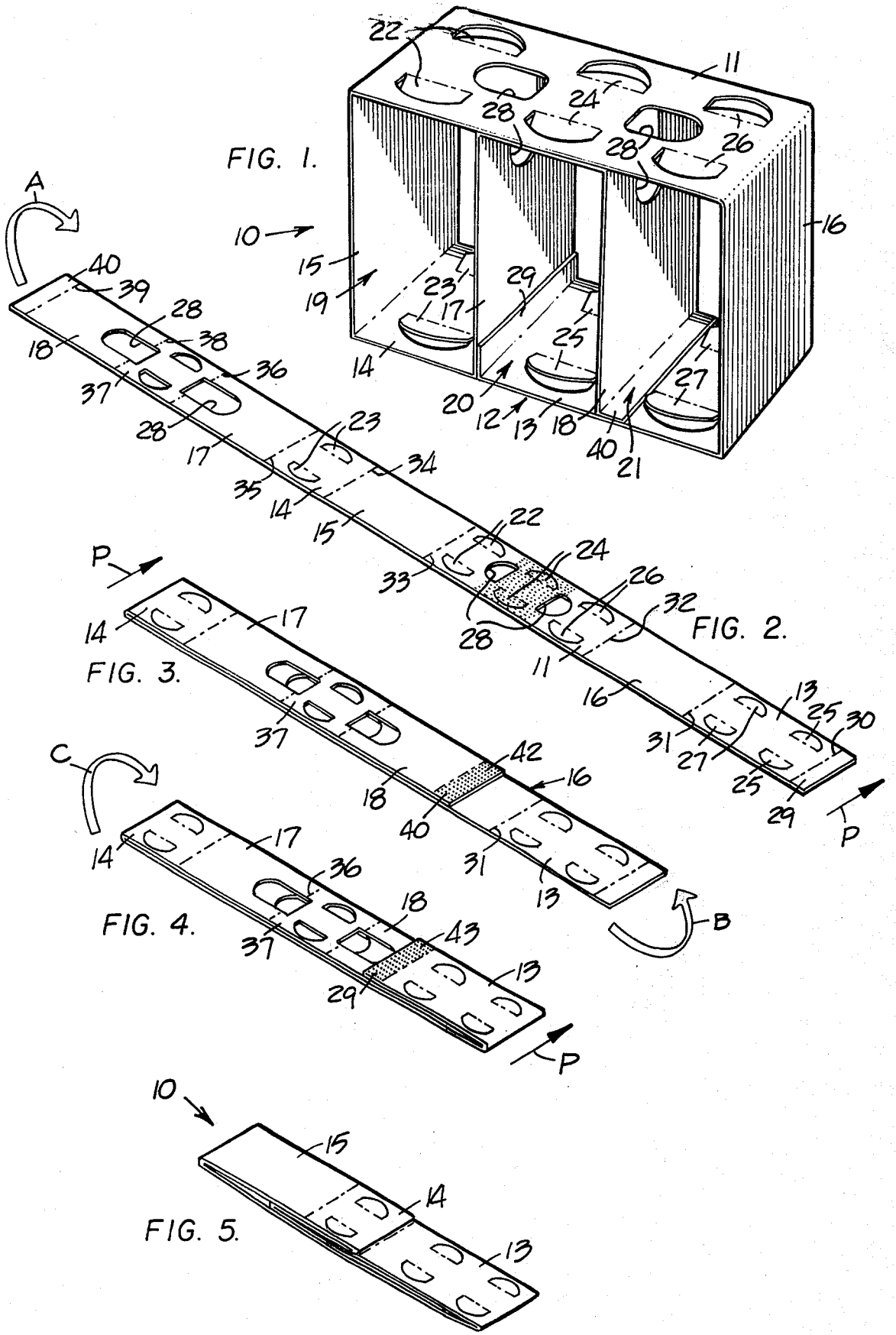
FIG. 1 is a perspective view illustrating a three cell wrap-around can carrier embodiment of this invention.
FIG. 2 is a bottom plan, isometric view of a one-piece blank utilized to make the FIG. 1 carrier.
FIGS. 3–5 sequentially illustrate folding and gluing steps for making the FIG. 1 erected carrier from the FIG. 2 blank.

A three-cell wrap-around can carrier 10, illustrated in FIG. 1, is adapted to be made from the one-piece paperboard blank illustrated in FIG. 2. The carrier comprises a top panel 11, a bottom panel 12, including a pair of co-planar panel portions 13 and 14, and a pair of upstanding end panels 15 and 16 integrally connected to the top and bottom panels. A pair of upstanding first and second partitions 17 and 18 are secured between the top and bottom panels and are disposed in parallel relationship between the end panels to define three cubical cells 19, 20 and 21, each adapted to retain a pair of articles (not shown) therein.

Such articles may comprise cylindrical cans having the chines thereof retained in the carrier by retention means, including pairs of arcuate lock tabs 22, 23, 24, 25, 26 and 27. In particular, each lock tab is adapted to be reverse-folded inwardly of the carrier on a respective top or bottom panel to engage an interior portion of a respective chine in the manner illustrated in U.S. Pat. No. 2,839,235, for example. In addition, the top panel and partitions may have finger holes 28 formed therethrough adapted to facilitate transportation of the carrier.

Referring to FIG. 2, the blank preferably comprises a one-piece paperboard blank suitably cut and scored to adapt it for expeditious formation into the FIG. 1 carrier by suitably modified conventional apparatus. The blank sequentially comprises a first flap 29 articulated to bottom panel portion 13 by a first scoreline 30, second and third scorelines 31 and 32 articulating end panel 16 to bottom panel portion 13 and top panel 11, fourth and fifth scorelines 33 and 34 articulating end panel 15 to the top panel and bottom panel portion 14, sixth and seventh scorelines 35 and 36 articulating first partition 17 to bottom panel portion 14 and a bridging panel 37, and eighth and ninth scorelines 38 and 39 articulating second partition 18 to the bridging panel and to a second flap 40 forming a part of partition 18.

FIGS. 2–5 sequentially illustrate folding and gluing steps employed during a converting operation to form the FIG. 1 carrier, wherein the blank is continuously moved along a linear path P. The first step in such method comprises applying an adhesive pattern 41, such as a standard glue, to the mid-portion of the underside of top panel 11, as shown in FIG. 2. The blank is then folded in the direction of arrow A to break it at scoreline 34 to secure bridging panel 37 to the underside of the top panel at adhesive pattern 41.

A second adhesive pattern 42 is then applied to the free end of flap 40 (FIG. 3) and the blank is folded in the direction of arrow B, at broken scoreline 31, to secure such flap to bottom panel portion 13 (FIG. 4). A third adhesive pattern 43 is then applied to the free end of flap 29 and the multi-layered blank is folded in the direction of arrow C in FIG. 4 to break the four scorelines 33–36 and to secure flap 29 to a lower inner surface portion of partition 17 (FIG. 1) to increase the structural integrity of the carrier thereat, i.e., the adhesive bond between partition 17 and flap 29 will be placed in shear when subjected to the vertical downward load of cans retained in cell 20 of the erected carrier. The completed carrier can be shipped to a packaging facility in its flattened condition and erected thereat and thereafter filled with a pair of cans in each of cells 19, 20 and 21 to form a six-pack.

I claim:

1. A side loading carrier formed from a one-piece blank comprising top and bottom panels, a pair of first and second end panels connected to said top and bottom panels, a pair of first and second partitions secured between said top and bottom panels and disposed in longitudinally spaced relationship between said end panels to define three cells in said carrier, including a pair of outer cells and an intermediate cell therebetween, each adapted to retain a pair of articles in side-to-side relationship therein, a folded first flap securing said bottom panel to an interior side of said first partition directly and disposed interiorly of said intermediate cell, and a second flap securing said second partition to said bottom panel directly and disposed interiorly of one of said outer cells, said bottom panel comprising a pair of co-planar first and second panel portions, said first flap connected to said first panel portion at a common scoreline and said second flap connected to said second partition at a common scoreline, and said first and second flaps are disposed at respective ends of said one piece blank and adhesive means are provided on only a common side of said first and second flaps.

2. The carrier of claim 1 wherein said second panel portion is further connected to said first end panel at a common scoreline.

3. The carrier of claim 2 wherein said first end panel is further connected to said top panel at a common scoreline.

4. The carrier of claim 3 wherein said top panel is further connected to said second end panel at a common scoreline.

5. The carrier of claim 4 wherein said second end panel is connected to the first panel portion of said bottom panel at a common scoreline.

6. The carrier of claim 1 further comprising retention means formed in at least one of said top and bottom panels, on either side of each of said first and second partitions, for retaining a pair of chined articles in each of the cells defined in said carrier upon insertion of said articles from a side of said cell.

7. The carrier of claim 6 wherein each of said retention means comprises a pair of arcuate lock tabs formed in at least one of said top and bottom panels by cut and scorelines to face laterally outwardly away from each other to facilitate side loading of articles therein from either side of said carrier.

8. The carrier of claim 7 wherein three pairs of said lock tabs are formed in each of said top and bottom panels with each pair of lock tabs formed in said top panel overlying a respective one of said cells and a respective pair of lock tabs formed in said bottom panel.

9. The carrier of claim 1 wherein said second flap is secured to the first panel portion of said bottom panel to extend towards said second end panel and wherein said one-piece blank terminates at opposite ends thereof at said first and second flaps.

10. The carrier of claim 1 wherein said first and second partitions are each integrally connected at a common scoreline to a bridging panel which bridges therebetween and is secured to an underside of said top panel.

* * * * *